United States Patent [19]

Schaef

[11] Patent Number: 5,013,258

[45] Date of Patent: May 7, 1991

[54] LATCHING ASSEMBLY FOR A LIGHT BULB AND ELECTRICAL SOCKET

[75] Inventor: Irving W. Schaef, Hialeah, Fla.

[73] Assignee: G.K.I., Miami, Fla.

[21] Appl. No.: 471,777

[22] Filed: Jan. 29, 1990

[51] Int. Cl.[5] ..... H01R 4/50

[52] U.S. Cl. ..... 439/347; 439/233

[58] Field of Search ..... 439/232, 233, 296, 299, 439/304, 345, 347, 356, 366, 368, 308

[56] References Cited

U.S. PATENT DOCUMENTS

| | | | |
|---|---|---|---|
| 804,387 | 11/1905 | Davis | 439/308 |
| 2,948,875 | 8/1960 | Batcheller | 439/347 |
| 4,228,486 | 10/1980 | Matsuya | 362/237 |
| 4,234,915 | 11/1980 | Malinowski et al. | 362/252 |
| 4,241,387 | 12/1980 | Bowers | 362/252 |
| 4,318,158 | 3/1982 | Livermore et al. | 362/29 |
| 4,471,414 | 9/1984 | Savage, Jr. | 362/226 |
| 4,599,682 | 7/1986 | Stephens | 362/103 |
| 4,679,126 | 7/1987 | Van Sickler | 362/226 |
| 4,871,323 | 10/1989 | Ohsumi | 439/347 |

FOREIGN PATENT DOCUMENTS

| | | | |
|---|---|---|---|
| 2105531 | 3/1983 | United Kingdom | 439/356 |

*Primary Examiner*—Joseph H. McGlynn
*Assistant Examiner*—Hien D. Vu
*Attorney, Agent, or Firm*—Collard, Roe & Galgano

[57] ABSTRACT

A latching structure designed to removably maintain connection between a base portion of a light bulb, such as a "Christmas Tree" or like decorative light, and a socket which includes electrical connection means for providing current to the base when the base is received therein from a conventional power supply.

8 Claims, 3 Drawing Sheets

FIG 2
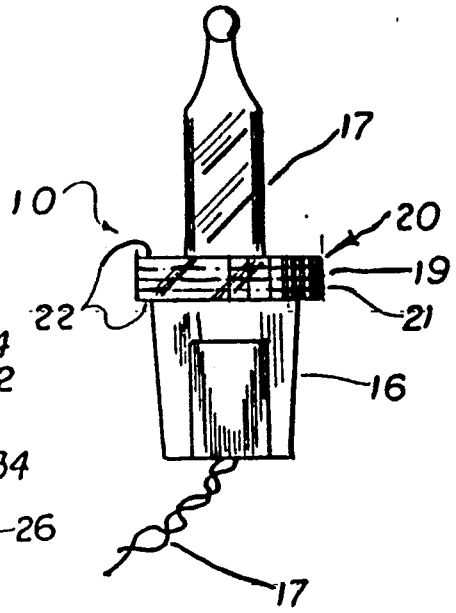
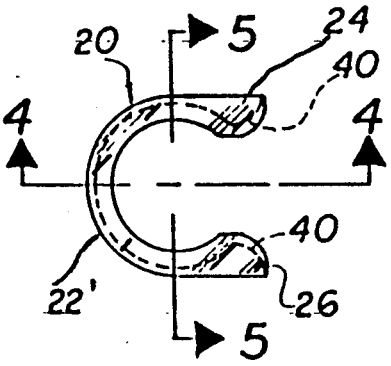
FIG. 3
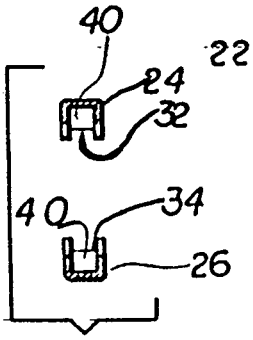
FIG. 5
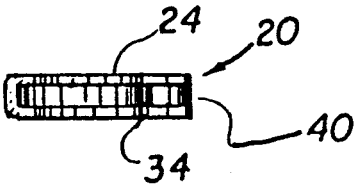
FIG. 4

LATCHING ASSEMBLY FOR A LIGHT BULB AND ELECTRICAL SOCKET

BACKGROUND OF THE INVENTION

1. Field of the Invention

A latching structure designed to removably maintain a light bulb and base portion thereof within an electrical socket which is wired for providing electrical current to the light bulb for activation thereof.

2. Description of the Prior Art

In the past, there have been numerous types of structures provided to assemble a light bulb, particularly a decorative type bulb such as used on Christmas Trees, and a base associated therewith together with an electrically wired socket. In such an assembly, the base of the light bulb is typically dimensioned and configured for snug fitting engagement within the socket such that a filament of the light bulb is disposed in electrical engagement with electrical connector means in the socket. In conventional or prior art structures, such an assembly typically included a light bulb secured to an exteriorly threaded metal base which may be screw threaded into engagement with an internally threaded recess of a socket. Electrical connections result from the assembly of the light bulb base and the socket. While functional, such prior art assemblies are not necessarily proven to be the most effective or economic from a manufacturing standpoint.

With the fairly recent advent of miniature decorative light bulbs, the type set forth above, generally abnormal forces exerted thereon resulted in the disengagement or overall destruction of the light bulb. Depending upon the particular wiring of a "string" of such light bulbs, one damaged bulb could result in the entire string being inoperative based on such string being wired in series or parallel. When the above problem occurs, it is often difficult to locate a particular light bulb and base which is no longer operative. Indeed, many people do not understand the replacement of a single damaged or inoperative bulb will allow the operation of the entire string in the intended fashion. Therefore, it is apparent and also recognized by those in the industry that electrical disengagement of one light bulb from its socket may result in an inoperativeness of the string and an overall dissatisfaction of the customer with this type of lighting arrangement. Such miniature light strings have gradually and unjustifiably developed a poor reputation with the consuming public thereby allowing their marketability to suffer.

There is a recognized need in the industry for a means of reliably and safely connecting a light bulb into the interior of an electrical socket in order to accomplish electrical interconnection and electrical current delivery to the light bulb for activation thereof. Such interconnection should be reliable to the extent of eliminating accidental disengagement or disconnection of the base of the bulb from the socket while at the same time allowing or facilitating removal or replacement of a truly inoperative bulb without fear of damaging the bulb or the necessity of applying excess force to the bulb when reattaching it to the socket.

SUMMARY OF THE INVENTION

The present invention relates to a retaining structure for removably connecting and maintaining electrical engagement between a light bulb and more particularly, a base portion thereof with an electrically wired socket.

While the present invention is described hereinafter in greater detail with specific reference to use of the subject assembly on miniature lighting assemblies of the decorative type, such structure could be adapted for use on light bulbs and accompanying sockets of varying dimensions and configurations and still be within the intended scope of the present invention.

The present invention therefore relates to the combination of electric light bulbs having a substantially conventionally configured or structured filament and an electrical connector means attached thereto. The electrical connector may be formed on the base which is specifically dimensioned and configured to fit within the interior portions of an electrical socket. The socket is of course wired by conventional electrical conductors to a source of electrical power such that current is delivered to the base when it is snugly disposed in its operative position within the socket. The socket includes an annularly configured flange mounted thereon and extending radially outward from the outer surface of the socket. A second flange is integrally formed on the base of the light bulb and also preferably has an annular configuration and extends radially outward from an outer surface of the base. The second flange of the socket is so disposed as to overlap and confrontingly engage and effectively rest upon the first flange of the socket when the light bulb and the socket are in their joined operative position. In such an operative position, the first and second flanges are disposed in immediately adjacent, engaging and parallel relation to one another.

An important feature of the present invention is the existence of a connector means generally in the form of an exteriorly mounted collar type structure. The connector means comprises two spaced apart legs generally disposed in parallel relation to one another and interconnected to one another at corresponding ends by a linking member. The two legs in the linking member are preferably formed of an integral one piece construction. A channel means is formed at least along the inner portions of the parallel legs and is transversely dimensioned to receive, in sliding engagement therein, the first and second flanges when such flanges and the light bulb and socket are disposed in the aforementioned operative position. Accordingly, the transverse dimension of the channel means is such as to effectively fit around such joined flanges and the "depth" of the channel means is such to substantially enclose the joined flanges at least about opposite portions thereof. An opening is present between spaced apart free ends of the legs and the channel means has an opening contiguous to such free ends so as to adequately receive the flanges therein.

In a preferred embodiment, the channel means extends continuously about the inner periphery of the connector means and extends continuously from one free end of one leg along the length of both legs and the interconnecting link to the opposite free end of the opposite leg. Further, the channel means may be defined by an inner substantially curvilinear peripheral configuration which may generally correspond to the somewhat annular configuration of the flanges when they are disposed and joined in their operative position. In a preferred embodiment, the flanges are effectively surrounded except for the possible area of the opening through which the flanges pass for their receiving engagement on the interior of the channel means. The flanges are therefore effectively "clamped" into their joined, operative position thereby securing and maintaining the base within the socket and the light bulb in connection with the electrical connector and power supply connected to the base.

Retaining projections are also mounted generally at the open ends of the channel means so as to ensure the prevention of inadvertent removal or slippage of the connector means from its retaining engagement relative to the flanges.

BRIEF DESCRIPTION OF THE DRAWINGS

For a fuller understanding of the nature of the present invention, reference should be had to the following detailed description taken in connection with the accompanying drawing in which:

FIG. 2 is a front plan view of the light bulb and socket with the connector member secured in retaining engagement thereto.

FIG. 3 is a top view of a preferred embodiment of FIG. 1.

FIG. 4 is a sectional view along line 4—4 of FIG. 3.

FIG. 5 is a sectional view along line 5—5 of FIG. 3.

Like reference numerals refer to like parts throughout the several views of the drawings.

DETAILED DESCRIPTION OF THE PREFERRED EMBODIMENT

Figure 1:
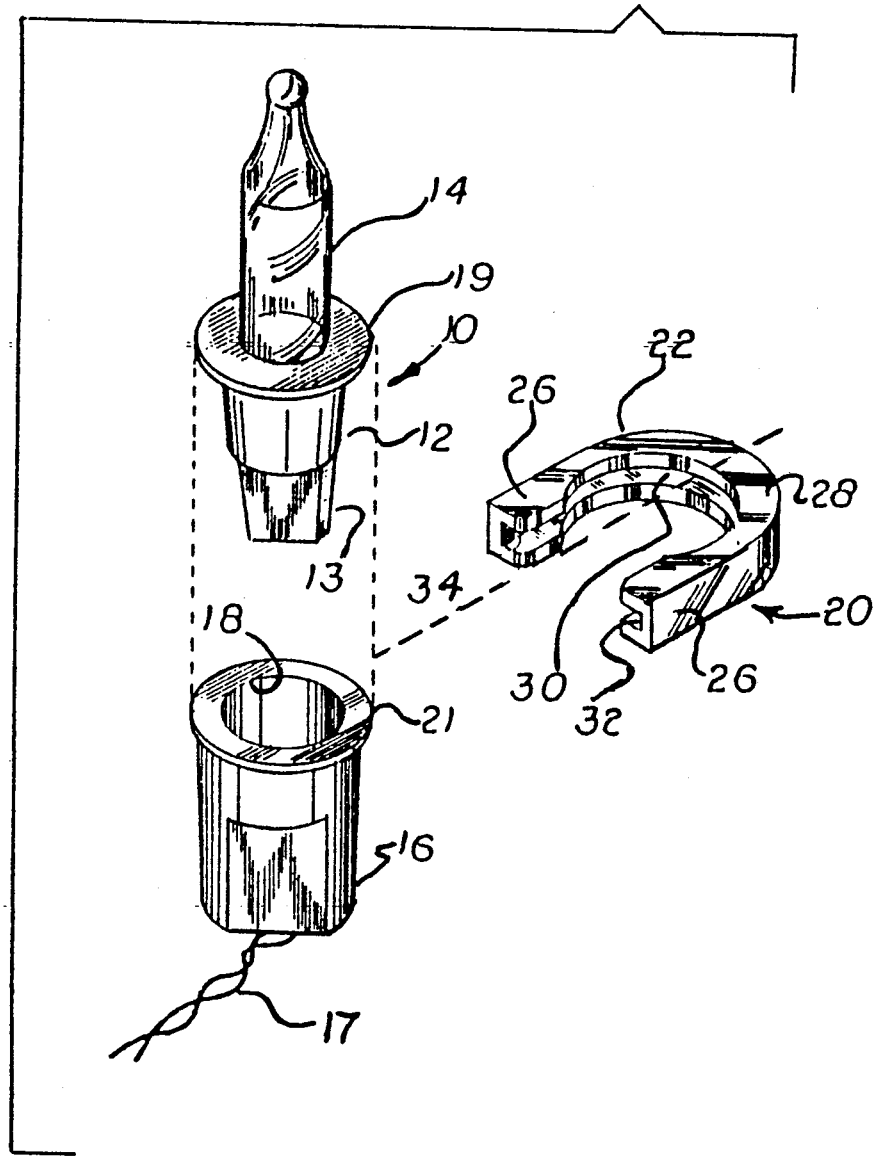
FIG. 1 is a perspective view in exploded form of a first preferred embodiment of the present invention.

As shown in FIG. 1, the present invention relates to a combination light bulb and socket assembly generally indicated as 10 and comprising a light bulb base 12 supporting the actual light bulb in which a conventional filament is mounted. The base 12 further includes an electrical connection or conductor structure as at 13 attached to the filament (not shown for purposes of clarity). A socket 16 is provided with a hollow interior as at 18. The interior 18 and the exterior portion of the base as at 12 and the conductor 13 are specifically dimensioned and configured such that the base snugly fits within the interior of the socket 16. A conventional electrical conductor 17 serves to interconnect the socket to a conventional source of electrical power and as is typical in the prior art to a "string" defined by a plurality of other light assemblies. Both the base 12 of the light bulb 14 and the socket 16 include outwardly extending flanges. More specifically, a first flange is defined on the socket as at 21 and a second flange is defined on the base 12 as at 19. Both of the first and second flanges have a substantially annular configuration and extend radially outward so as to project beyond the respective exterior surfaces of the base 12 and socket 16.

As shown in FIG. 2, an operative engagement of the light bulb 14, base 12 and socket 16 is their mating engagement such that the base 12 fits within the interior 18 of the socket 16 to establish electrical connection between the source of electrical power through conductor 17 and the filament maintained on the interior of the bulb 14. An important feature of the present invention is the existence of a connector means generally indicated as 20 in a first preferred embodiment and as 20′ in a second preferred embodiment. Naturally, only one of the embodiments 20 or 20′ are used as will be evident from a more detailed description as provided hereinafter.

The connector means 20 has a collar like configuration defined by a base 22 having an integral one piece construction including two spaced apart parallel legs 24 and 26 interconnected by a connecting link 28. Further, a channel means extends along continuously the inner portion of the base 22 including along the entire length of both legs 24 and 26 as well as the length of the connecting link 28. The channel means 30 begins at the free ends 32 and 34 of the respective legs 24 and 26 by an opening therein. In addition, two projections extend outwardly and are indicated as 40. These projections 40 do not extend beyond or outwardly of the channel means but are disposed adjacent the free ends 32 and 34 of the base 22 as clearly shown. The projection means are used in cooperation with the inherent flexibility of the legs 24 and 26. In order to retain the bulb 14, base 12 and socket 16 and their connected, operable position as shown in FIG. 2, the channel means 30 is dimensioned to substantially receive therein and maintain in a confronting, engaging and sandwiched relation of the first and second flanges 19 and 21. As shown in FIG. 2, the flanges 19 and 21 are therefore sandwiched into such confronting engagement by being received within the channel 30. Inner portions of the periphery of the base 22 may be substantially curvilinear or semi-circular so as to almost surround the entire portion of the mating flanges. An opening in fact does exist between the free ends 32 and 34 of sufficient dimension to allow passage or sliding receipt of the flanges 19 and 21 when in their operative position again as shown in FIG. 2. The projections 40 are disposed such that when the flanges 19 and 21 engage such projection as they enter the channel means 30, the legs 24 and 26 are flexed outwardly due to their inherent flexibility. Once the flanges are received totally within the channel means 30, these projections facilitate inadvertent disconnection of the connector means from its engaged, connected position relative to the flanges.

As shown in FIG. 1, the embodiment 20 has a substantially curvilinear outer peripheral configuration along the length of the connecting link 28.

Figure 6:
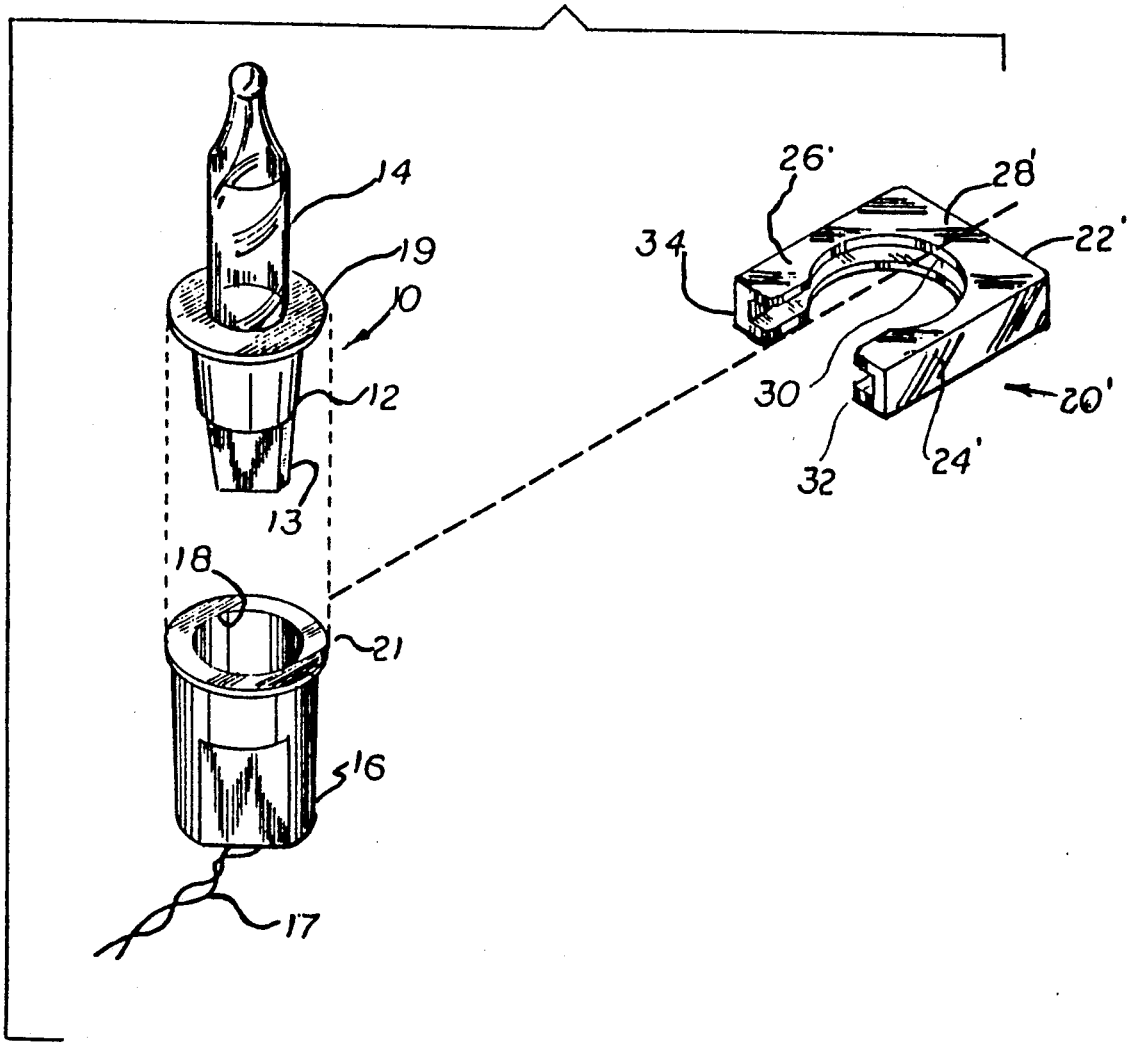
FIG. 6 is a perspective view in exploded form of a second preferred embodiment of the present invention.

The second preferred embodiment 2′, as shown in FIG. 6, includes the two legs 24′ and 26′ connected by a connecting link 28′ defining the base 22′. A channel 30 extends along the length thereof similar to that as in the embodiment 20. The primary difference is the square, multi-sided outer or exterior peripheral configuration of the base 22′ perhaps providing the connector means 20′ in its operative engagement as shown in FIG. 2.

Now that the invention as been described,

What is claimed is:

1. A decorative string set of miniature light bulbs comprising in combination:

(a) an electrically wired socket including electrical connection means in the socket, (b) a light bulb with an associated filament, a base and electrical leads coupled to said filament and mounted on said base in exposed relation for connection to said electrical connection means, said base being sized and configured for snug receipt of said socket.

(c) a first flange secured to said socket and extending outwardly from an outer surface thereof, (d) a second flange mounted on said base and extending outwardly from an outer surface of said base, (e) said base and said socket cooperatively dimensioned and configured to removably position said base within said socket in an operative position defined by electrical connection therebetween.

(f) said operative position further defined by adjacent, parallel disposition of said first and second flanges with one another, and (g) a resilient interiorly channeled collar, dimensioned and configured to receive said flanges, in order to maintain in a confronting, engaging and sandwiched relation said light bulb to said socket and structured to concurrently engage said first and second flanges, said collar having spaced apart legs with outwardly extending projections formed within said collar, said collar having sufficient flexibility to expand outwardly from a normal position upon engagement of said projections with said flanges when in said operative position, said projections disposed and dimensioned to resist sliding disengagement of said flanges from said collar when fully engaged.

2. An assembly as in claim 1 wherein said connector means comprises spaced apart legs separated at free ends thereof by an opening of sufficient dimension to allow passage of said flanges, when in said operative position therebetween, said channel means formed along a length of each of said legs.

3. An assembly as in claim 2 wherein said channel means comprises two channel segments each integrally formed along an inner portion of a different one of said legs and each disposed and configured to removably receive substantially opposite portions of said flange within said operative position.

4. An assembly as in claim 2 wherein said connector means comprises a substantially U-shaped configuration, said legs connected at an opposite end relative to said opening by a connecting link, said channel means extending along a length of said connector member formed on each of said legs to removably engage substantially opposite sides of said flanges within said operative position.

5. An assembly as in claim 4 wherein said channel means comprises an integrally formed channel extending continuously along an inner portion of each of said legs and said connecting link and between said free ends of said legs.

6. An assembly as in claim 4 wherein said connecting link comprises a substantially curvilinear configuration integrally secured to correspondingly positioned ends of said legs and oppositely disposed to said opening.

7. An assembly as in claim 4 wherein said legs and said connecting link collectively comprise a substantially rectangular exterior peripheral configuration.

8. An assembly as in claim 4 wherein said legs and said connecting link comprise a curvilinear interior peripheral configuration disposed contiguous to said channel means.

* * * * *